United States Patent [19]

Hayashi

[11] Patent Number: 4,590,900

[45] Date of Patent: May 27, 1986

[54] VALVE SUPPORTING ARRANGEMENT OF AN INTERNAL COMBUSTION ENGINE

[75] Inventor: Yoshimasa Hayashi, Kamakura, Japan

[73] Assignee: Nissan Motor Co., Ltd., Yokohama, Japan

[21] Appl. No.: 470,374

[22] Filed: Feb. 28, 1983

[30] Foreign Application Priority Data

Mar. 2, 1982 [JP] Japan ..... 57-32726

[51] Int. Cl.[4] ..... F01L 1/00

[52] U.S. Cl. ..... 123/90.67; 123/188 SB; 267/179

[58] Field of Search ..... 123/90.67, 188 SB, 188 SC, 123/188 SA; 267/179; 402/66, 69

[56] References Cited

U.S. PATENT DOCUMENTS

| | | | |
|---|---|---|---|
| 1,554,227 | 9/1925 | Nickol | 251/144 |
| 1,930,894 | 10/1933 | Gorman | 251/144 |
| 2,065,794 | 12/1936 | Colwell | 251/144 |
| 3,043,284 | 7/1962 | Gunstrom | 123/90.67 |
| 3,612,016 | 10/1971 | Jelen | 123/90.67 |

FOREIGN PATENT DOCUMENTS

| | | | |
|---|---|---|---|
| 459630 | 5/1928 | Fed. Rep. of Germany | 123/188 SA |
| 217504 | 6/1924 | United Kingdom | 123/90.67 |

*Primary Examiner*—Michael Koczo
*Assistant Examiner*—Peggy A. Neils
*Attorney, Agent, or Firm*—Schwartz, Jeffery, Schwaab, Mack, Blumenthal & Koch

[57] ABSTRACT

The upper retainer for retaining an upper portion of a valve spring is shaped like a perforated spinning top and is axially dividable into two identical elements which are coaxially disposed about the upper portion of the valve stem when assuming its operative condition. The retainer has, when assuming the operative position, a configuration which comprises a collar portion which is sized to be coaxially disposed within an upper portion of the valve spring, an annular flange portion extending radially outward from the upper end of the collar portion and engaging with the upper end of the valve spring, and means for achieving a spline connection between the central portion of the retainer and the upper portion of the valve stem.

6 Claims, 8 Drawing Figures

VALVE SUPPORTING ARRANGEMENT OF AN INTERNAL COMBUSTION ENGINE

BACKGROUND OF THE INVENTION

The present invention relates to a valve device of an internal combustion engine, and more particularly to a valve supporting arrangement for axially movably supporting an intake (or exhaust) valve of the engine.

SUMMARY OF THE INVENTION

According to the present invention, there is provided an improved valve supporting arrangement of an internal combustion engine, which is characterized by its simple, light weight and low cost construction.

According to the present invention, there is provided a valve supporting arrangement of an internal combustion engine, which comprises a rigid member for supporting the axially movable stem portion of the valve, an upper retainer mounted to the upper portion of the valve stem, a lower annular retainer disposed on the rigid member therethrough the valve stem, and a coil spring compressed between the upper and lower retainers to bias the valve in a direction to close the associated opening, wherein the upper retainer is shaped like a perforated spinning top and has, when operatively mounted to the upper portion of the valve stem, a configuration which comprises a collar portion sized to be coaxially disposed within an upper portion of the coil spring, an annular flange portion radially outwardly extending from the upper end of the collar portion and engaging with the upper end of the coil spring, and means for achieving a spline connection between the central portion of the retainer and the upper portion of the valve stem, and wherein the upper retainer is axially dividable into two identical elements which are coaxially disposed about the upper portion of the valve stem when assuming their operative positions.

BRIEF DESCRIPTION OF THE DRAWINGS

Objects and advantages of the present invention will become apparent from the following description when taken in conjunction the accompanying drawings, in which.

DETAILED DESCRIPTION OF THE INVENTION

Prior to describing the invention, one of conventional valve supporting arrangements will be described with reference to FIGS. 1 to 3 in order to clarify the invention.

Figure 1:
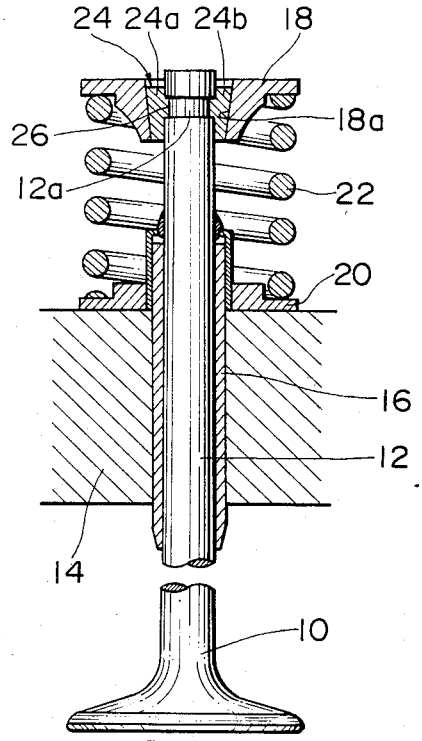
FIG.1 PRIOR ART
FIG. 1 is a longitudinally sectioned view of a valve supporting arrangement having a conventional construction.
Figure 2:
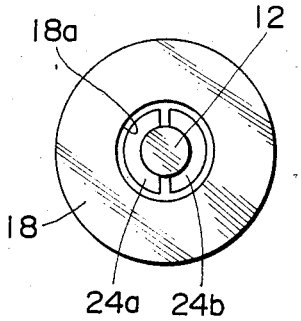
FIG.2 PRIOR ART
FIG. 2 is a plan view of the conventional valve supporting arrangement of FIG. 1.
Figure 3:
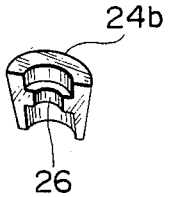
FIG.3 PRIOR ART
FIG. 3 is a perspective view of one of paired identical elements of a collet employed in the conventional valve supporting arrangement.

Referring to FIGS. 1 to 3, especially FIGS. 1 and 2, there is shown the conventional valve supporting arrangement of an internal combustion engine, which is designed to operatively support an intake (or exhaust) valve 10 of the engine. The valve 10 is axially movably supported at its stem portion 12 by a cylinder head (or rigid member) 14 through a valve guide 16 secured to the cylinder head 14. A circular upper retainer 18 is fixed through the after-mentioned member to the upper portion of the valve stem 12, and an annular lower retainer 20 is disposed on the cylinder head 14 putting therethrough the valve guide 16, as shown. A coil spring 22 is compressed between the upper and lower retainers 18 and 20 to bias the valve 10 in a direction to close the corresponding intake opening (or exhaust opening) formed in the cylinder head 14. In order to fix the upper retainer 18 to the upper portion of the valve stem 12, a dividable collet 24 is employed, which is coaxially disposed between the upper portion of the valve stem 12 and the upper retainer 18 and comprises two identical elements **24*a* and 24*b*. As is seen from FIG. 3, each element 24*a* or 24*b* comprises a semicylindrical portion having a tapered cylindrical outer surface. The cylindrical inner surface of the element 24*b* or 24*a* is formed with a radially inwardly projecting ridge portion 26. As is seen from FIG. 1, the circular upper retainer 18 is formed with a central bore 18*a* of which surface is tapered and shaped to match with the tapered outer surface of the collet 24. The upper portion of the valve stem 12 is formed with an annular groove 12*a* which is sized to match with the inward ridge portion 26 of the collet 24. As is understood from FIG. 1, the engagement between the upper retainer 18 and the valve stem 12 is tightly effected by the collet 24** which offers them a so-called dove-tail connection.

However, in the conventional valve supporting arrangement as stated hereinabove, the following disadvantages have been encountered due to its inherent construction. First, not only the upper retainer 18, but also the collet 24 is considerable in weight thereby causing increase in inertia mass of the moving elements of the valve supporting arrangement. This induces not only a necessity of using a stronger material as the biasing spring 22, but also a necessity of using a stronger rocker arm. Second, the manufacturing of the collet 24 requires a precise and costly machining technique. These first and second matters cause the production of the valve supporting arrangement to be costly and complicated.

Thus, it is an essential object of the present invention to provide a valve supporting arrangement which is free of the above-mentioned drawbacks.

Figure 4:
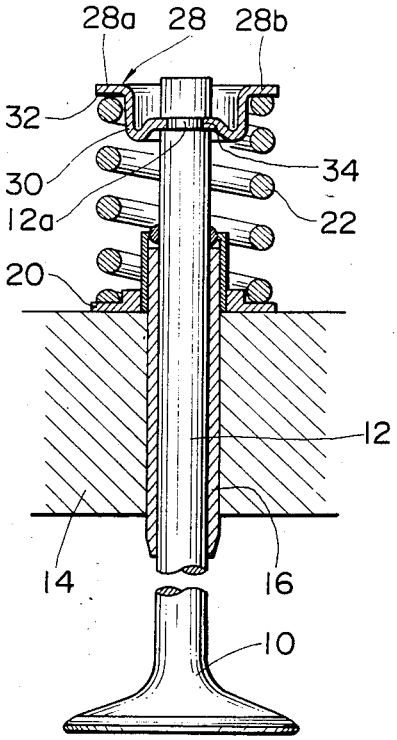
FIG. 4 is a longitudinally sectioned view of a valve supporting arrangement of a first embodiment of the present invention.
Figure 6:
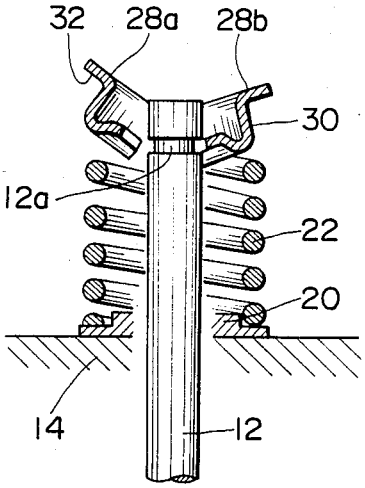
FIG. 6 is a partial and sectioned view of the valve supporting arrangement of the first embodiment, depicting the assembling process of the arrangement.
Figure 5:
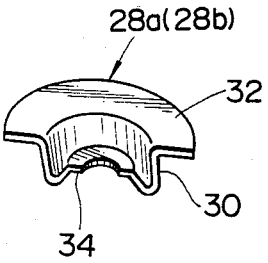
FIG. 5 is a perspective view of one of paired identical elements of an upper retainer employed in the first embodiment.

Referring to FIGS. 4 to 6, especially FIG. 4, there is shown a valve supporting arrangement of a first embodiment of the present invention. For ease with which the following description proceeds, identical parts and portions to the arrangement of FIG. 1 are designated by the same numerals. In this first embodiment, an upper retainer 28 is only employed for retaining the upper end of the coil spring 22, unlike the case of the above-mentioned conventional arrangement.

The upper retainer 28 is shaped like a perforated spinning top and is axially dividable into two identical elements 28*a* and 28*b* which are produced by stamping or press-forming a metal sheet, such a steel sheet or the like. The retainer 28 has, when assuming a finished condition, a configuration which comprises a collar portion 30 having an outer diameter substantially equal to or slightly larger than the inner diameter of the upper end portion of the coil spring 22, an annular flange portion 32 radially outwardly extending from the upper end of the collar portion 30, and an annular ridge portion 34 radially inwardly extending from the lower end of the collar portion 30. For increase in mechanical strength, the annular ridge portion 34 is raised at its central portion toward the annular flange portion 32. Upon assemblage, the two identical elements 28*a* and 28*b* of the retainer 28 are mounted to the upper portion of the valve stem 12, having the annular flange portion 32 thereof engaged with the uper end of the coil spring 22 and having the annular ridge portion 34 thereof received in the annular groove 12*a* of the valve stem 12. With this, the two identical elements 28*a* and 28*b* are forced to combine each other to have the spinning top shape by the biasing force of the spring 22, having the collar portion 30 thereof disposed within the spring 22, as shown in FIG. 4.

FIG. 6 depicts the assembling process of the retainer 28. With the spring 22 being compressed, the two elements 28*a* and 28*b* are attached to the valve stem 12 in such a manner that the annular ridge portion 34 of each element 28*a* or 28*b* is received in the annular groove 12*a* of the valve stem 12 to achieve a spline connection therebetween, and then with the elements 28*a* and 28*b* being thus attached to the valve stem 12, the spring 22 is released to span between the upper retainer 28 and the lower retainer 20. With this, the elements 28*a* and 28*b* are instantly raised on the valve stem 12 to assume the finished or complete shape of the retainer 28.

The following advantages are expected from this first embodiment. Because the retaining of the upper portion of the coil spring 22 to the valve stem 12 is achieved by only the press-formed member 28 which is light in weight, the inertia mass of moving elements of the valve supporting arrangement is considerably reduced as compared with the above-mentioned conventional one. Thus, the requirement for using a stronger spring and a stronger rocker arm becomes unnecessary. In addition, since the retainer 28 can be produced by the inexpensive press-forming technique, the production cost of the arrangement is reduced.

Figure 7:
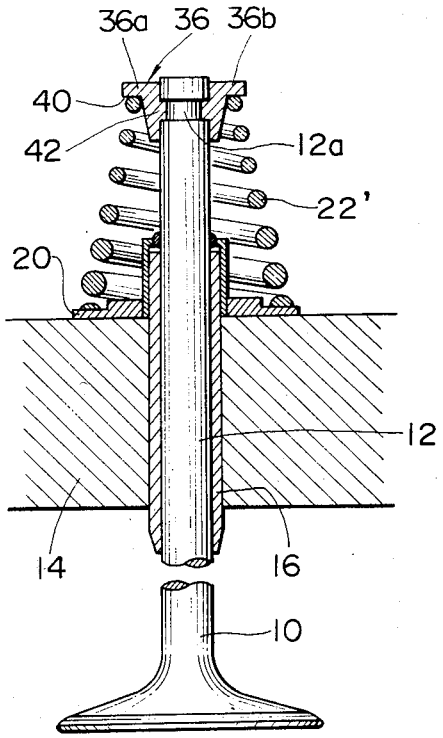
FIG. 7 is a longitudinally sectioned view of a valve supporting arrangement of a second embodiment of the present invention.
Figure 8:
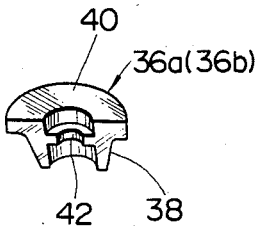
FIG. 8 is a perspective view of one of paired identical elements of an upper retainer employed in the second embodiment.

Referring to FIGS. 7 and 8, especially FIG. 7, there is shown a second embodiment of the present invention. The valve supporting arrangement of this second embodiment is particularly suitable to a case wherein a conical coil spring 22' is used as the valve biasing spring. Also, in this second embodiment, an upper retainer 36 is only used for retaining the upper portion of the spring 22', similar to the case of the first embodiment.

The upper retainer 36 is axially dividable into two identical elements 36*a* and 36*b* which are produced by a forging technique or a casting technique. The retainer 36 has, when assuming a finished condition, a configuration which comprises a collar portion 38 having an outer cylindrical surface smoothly tapered, and an annular flange portion 40 extending radially outward from the upper end of the collar portion 38. The maximum diameter portion, that is the uppermost portion, of tapered collar portion has a diameter substantially equal to or slightly larger than the diameter of the diametrically reduced upper end of the conical spring 22'. As is understood from FIG. 8, the cylindrical inner surface of each of the elements 36*a* and 36*b* is formed with a radially inwardly projecting ridge portion 42. Upon assemblage, the two elements 36*a* and 36*b* of the retainer 36 are mounted to the upper portion of the valve stem 12, having the annular flange portion 40 thereof engaged with the upper end of the conical spring 22' and having the inward ridge portion 42 thereof received in the annular groove 12*a* of the valve stem 12. With this, the two elements 36*a* and 36*b* are forced to have the shape of the spinning top by the biasing force of the spring 22', having the tapered collar portion 38 thereof disposed within the spring 22', as shown in FIG. 7. Preferably, the configuration of the inner surface of the retainer 36 is shaped to match with the external shape of the upper portion of the valve stem 12. In this case, the connection of the retainer 36 to the valve stem 12 is more tightly achieved.

Since the assembling process of the retainer 36 is very similar to that of the afore-mentioned first embodiment, explanation of it will be omitted. It is to be noted that the tapered outer surface of the retainer 36 induces the easy and assured settlement of the upper end of the conical spring 22' on the annular flange portion 40 of the retainer 36, upon releasement of the spring 22' in the assembling process. If desired, the conical spring 22' may be formed of a spring wire of which diameter is gradually reduced toward the upper portion of the spring 22' as shown.

Similar to the case of the first embodiment, because the retaining of the upper portion of the coil spring 22' is achieved by only one member 36 which is light in weight, the inertia mass of moving elements of the valve supporting arrangement is reduced as compared with the conventional one. Thus, the requirement for using a stronger spring and a stronger rocker arm becomes unnecessary. This induces reduction in production cost of the valve supporting arrangement.

What is claimed is:

1. A supporting arrangement for a valve of an internal combustion engine having a valve stem portion, comprising a rigid member for supporting the stem portion of the valve for axial movement of the valve, a stamped or press-formed upper retainer connected to the upper portion of the valve stem, a lower annular retainer disposed on the rigid member and surrounding the valve stem, and a coil spring compressed between the upper and lower retainers to bias the valve in a direction to close the associated valve opening, wherein said upper retainer has a substantially constant thickness throughout and comprises an annular collar portion having an essentially constant diameter along the length thereof with the diameter being at least substantially equal to the inner diameter of the coil spring, said collar portion being coaxially disposed within an upper portion of the coil spring, an annular flange portion extending radially outwardly from the upper end of the collar portion and engaging with the upper end of the coil spring, and means for achieving a spline connection between the central portion of the retainer and the upper portion of the valve stem, and wherein the upper retainer is divided along a diameter thereof into two identical elements which are disposed about the upper portion of the valve stem such that the radial pressure exerted by said coil spring operates to bias said identical elements into their respective positions operative to connect the upper retainer to the valve stem.

2. A valve supporting arrangement as claimed in claim 1, in which said means comprises an annular ridge portion which extends radially inwardly from the lower inside surface of said upper retainer, said annular ridge portion being received in an annular groove formed in said valve stem thereby to achieve the spline connection therebetween.

3. A valve supporting arrangement as claimed in claim 2, in which said annular ridge portion extends from the lower end of said collar portion.

4. A valve supporting arrangement as claimed in claim 3, in which the annular ridge portion is raised at its central portion toward the annular flange portion for increasing the mechanical strength thereof.

5. A valve supporting arrangement as claimed in claim 4, in which each element of said upper retainer is produced by stamping a metal sheet.

6. A valve supporting arrangement as claimed in claim 1, wherein the outer diameter of said collar portion is substantially equal to the inner diameter of the upper portion of said coil spring.

* * * * *